US005266061A

United States Patent [19]

Poldervaart et al.

[11] Patent Number: 5,266,061

[45] Date of Patent: Nov. 30, 1993

[54] SHIP WITH MOORING MEANS

[75] Inventors: Leendert Poldervaart, La Turbie, France; Michael Stambouzos, Melbourne, Australia

[73] Assignee: Single Buoy Moorings Inc., Marly, Switzerland

[21] Appl. No.: 753,101

[22] Filed: Aug. 30, 1991

Related U.S. Application Data

[63] Continuation-in-part of Ser. No. 555,810, Jul. 23, 1990, Pat. No. 5,052,322, which is a continuation of Ser. No. 319,317, Mar. 6, 1989, abandoned.

[30] Foreign Application Priority Data

Apr. 19, 1988 [NL] Netherlands ..... 8801007

[51] Int. Cl.[5] ..... B63B 22/02

[52] U.S. Cl. ..... 441/5; 114/230; 441/4

[58] Field of Search ..... 114/230, 264, 265; 441/3-5; 384/112, 113

[56] References Cited

U.S. PATENT DOCUMENTS

| | | | |
|---|---|---|---|
| 3,525,312 | 8/1970 | Beck | 441/5 |
| 3,620,181 | 11/1971 | Naczkowski | 441/5 |
| 4,604,961 | 8/1986 | Ortloff | 114/230 |
| 4,698,038 | 10/1987 | Key | 441/5 |
| 4,701,143 | 10/1987 | Key | 441/5 |
| 4,765,378 | 8/1988 | Engelskirchen | 141/69 |
| 4,841,895 | 6/1989 | Brewerton | 114/230 |
| 4,892,495 | 1/1970 | Svensen | 114/230 |
| 4,955,310 | 9/1990 | Pollack | 114/230 |

FOREIGN PATENT DOCUMENTS

| | | |
|---|---|---|
| 228966 | 9/1987 | European Pat. Off. . |
| 1447413 | 8/1976 | United Kingdom . |
| 2150517 | 7/1985 | United Kingdom . |

*Primary Examiner*—Robert J. Oberleitner
*Assistant Examiner*—Clifford T. Bartz
*Attorney, Agent, or Firm*—Young & Thompson

[57] ABSTRACT

Ship with mooring structure, comprising a rotatable tube (15) which is connected to the ship (1) for rotation about a vertical axis which is concentric to the rotatable tube, by an axial/radial bearing structure (17) which can absorb axial and radial forces. The rotatable tube (15) has at its lower end structure (19) for fastening anchor chains or cables (21). The rotatable tube (15) is disposed inside the hull of the ship (1) within a fixed tube (3) through the lower end of which the rotatable tube (15) protrudes downwardly. An outer ring of the axial/-radial bearing (17) is in integral assembly with a rigid ring (13) which is in turn fastened only to the lower end of the fixed tube (3). The fixed tube (3) encloses the rotatable tube (15) with clearance and is fastened to the hull of the ship only some distance away from and above the rigid ring (13) and is free from fixed securement to the ship below the rigid ring (13). Racking of the hull thus cannot be transmitted to the bearing but rather is absorbed by that portion of the fixed tube that extends between the hull and the rigid ring (13).

5 Claims, 1 Drawing Sheet

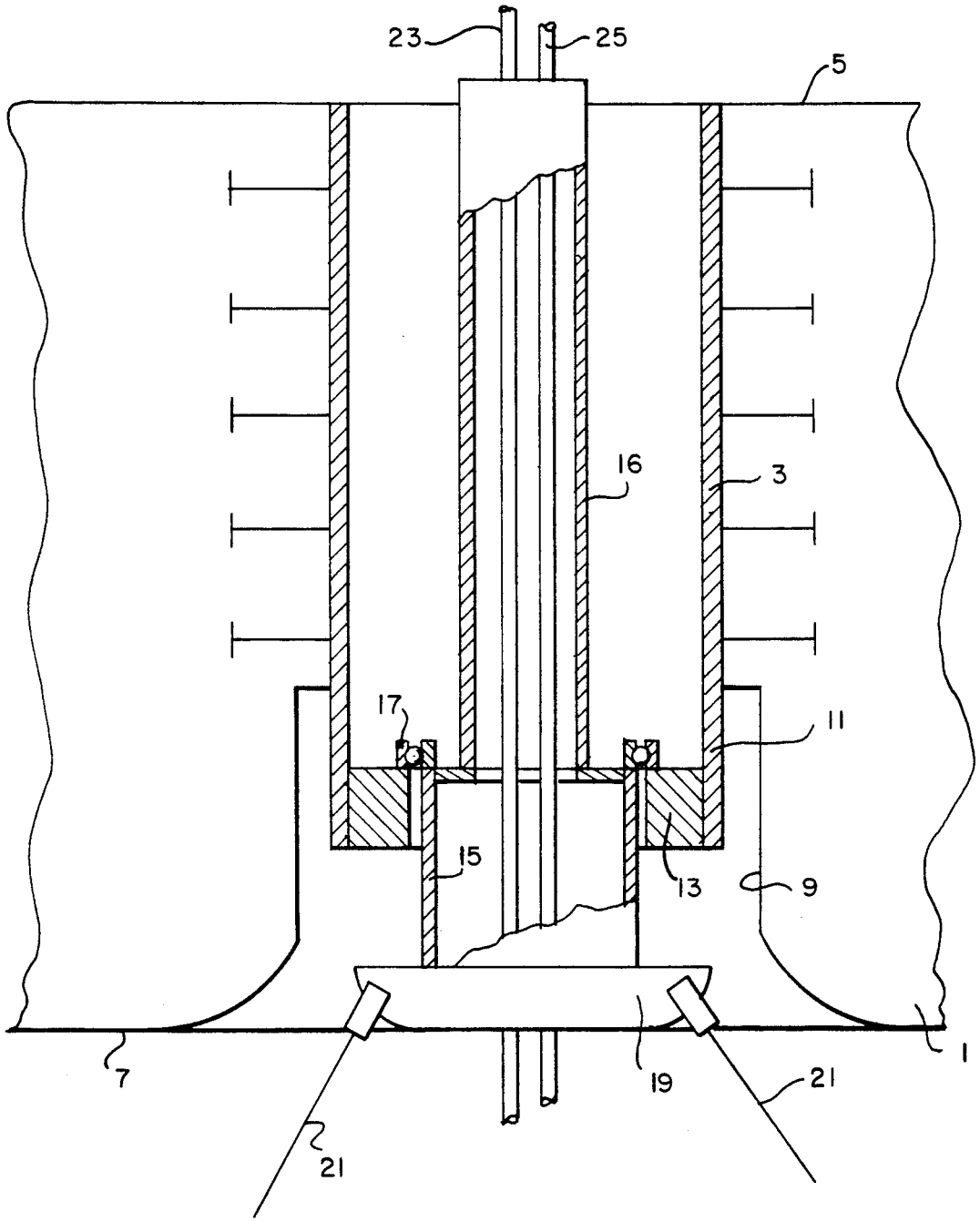
23
25
5
16
3
17
11
15
13
9
7
19
21
1
21

SHIP WITH MOORING MEANS

CROSS REFERENCE TO RELATED APPLICATIONS

This application is a continuation-in-part of copending Ser. No. 07/555,810 filed Jul. 23, 1990, now U.S. Pat. No. 5,052,322, which is a continuation of Ser. No. 07/319,317 filed Mar. 6, 1989, now abandoned the disclosure of which is incorporated herein by reference.

BACKGROUND OF THE INVENTION

The present invention relates to a ship with mooring means, comprising a tube or turret which is mounted on the ship for rotation about a vertical axis relative to the ship by means of a bearing structure which can absorb axial and radial forces, such as a combined axial/radial bearing, of which bearing structure at least the part absorbing the axial forces is mounted on the tube with the outer ring of the bearing supported on the ship and the tube having at its lower end means for fastening anchor chains or cables.

Such a ship is disclosed in U.S. Pat. No. 4,660,494. In such a known ship, the rotary tube is supported in a top and bottom carrier projecting beyond the bow of the ship, the top end of the rotary tube being fastened to the inner ring of an axial/radial bearing whose outer ring is fastened to the bearing structure of the ship which projects beyond the bow of the ship. The rotary tube is supported by a radial bearing near its lower end.

These bearings are made with great precision and make it possible for the ship to turn with minimum resistance about the tube which is secured to the bottom of the body of water with anchor chains. This is a disadvantageous location for the bearing, however, because the bow of the ship can be subjected to powerful movements and wave forces.

U.S. Pat. No. 3,440,671 provides within the hull of the ship a cylindrical hollow chamber, in which is disposed a tubular element which has buoyancy and has means for the securement of anchor chains and is provided with sets of wheels fitted at intervals along its periphery, permitting turning of the ship and tubular element relative to each other. This mutual support of the ship and tube also permits the relative turning even if as a result of the movements of the ship deformations of the walls of the cylindrical tube occur. This cylindrical tube becomes deformed to an oval shape under certain load conditions. If the sets of wheels are self-adjusting, then sufficient play is available to tolerate such deformation.

But if it is desired to use a precisely made axial/radial bearing working with considerably less friction than the wheels of U.S. Pat. No. 3,440,671, or the combination of an axial bearing with a radial bearing at points which are spaced apart as in U.S. Pat. No. 4,660,494, then this is not possible with the known constructions, because the axial/radial bearing is exposed to the deformation imposed by the racking of the hull under the force of the waves.

Another such construction in which a reinforcing ring for the bearing is nevertheless subjected to the racking of the hull under the force of the waves, because it is directly connected to the hull, is found in U.K. patent Appln. 2 150 517A; and this construction also is inconsistent with the provision of a precisely made bearing.

SUMMARY OF THE INVENTION

Accordingly, it is an object of the present invention to provide a ship with mooring means of the type mentioned in the preamble, in which the mooring means are desirably positioned a distance away from the bow, and yet are not subjected to the deformations undergone by the hull.

This object is achieved, according to the present invention, by placing the rotary tube or turret inside the hull of the ship, amidships or toward the bow or the stern of the ship, in a chamber which is open at least at its bottom, the outer ring of the axial bearing or the radial/axial bearing being fixed to a rigid ring which in turn is fastened to the lower end of a fixed tube which encloses the rotary tube with clearance and which is secured to the hull of the ship only some distance away from and above the rigid ring.

There is thus, between the rigid ring and the hull of the ship, a substantial vertical length of the fixed tube which is subject at its upper end to the deformations imposed by racking of the hull but cannot, at its lower end, pass along those deformations to the rigid ring in such a way as would deform the rigid ring and with it the outer ring of the bearing, because the vertically extending portion of the fixed tube between the hull and the rigid ring serves as a deformable sacrificial sleeve which effectively absorbs the deformations imposed by the hull rather than passing those deformations along to the rigid ring.

It thus becomes possible, according to the present invention, to position the turret or rotary tube inside the hull, a substantial distance from opposite ends of the hull so as to minimize the effect of pitching and yawing of the vessel, while at the same time providing precision bearing structure, because there is no longer any force acting on the outer bearing ring that could deform it.

In addition to the axial/radial bearing, a radial bearing can be provided for an upper portion of the rotary tube. This radial bearing can, however, be omitted, depending on the rigidity and height of the rotary tube.

The fixed tube, which must thus permit deformation at one end without passing along that deformation to the rigid ring, need not be higher than the necessary distance between the rigid ring and the deforming part of the hull. This fixed tube can, however, extend over the entire height of the open chamber and can then, together with the rotary tube, provide space for a radial bearing located near the upper end of the rotary tube.

BRIEF DESCRIPTION OF THE DRAWING

The invention will be better understood by reference to the accompanying single figure of drawing, which shows schematically in partial cross section and with parts broken away, an embodiment of part of a ship according to the invention.

DETAILED DESCRIPTION OF THE INVENTION

The ship 1 shown in the drawing is provided preferably amidships, and in any event a substantial distance from both the bow and the stern, with a vertical cylindrical tube 3, forming a hollow chamber which, in the illustrated embodiment, extends most of the height of the ship, from the deck 5 to adjacent the bottom 7.

It is to be particularly noted that only the upper portion of the tube 3 is fixedly secured to the hull. The hull includes, on its underside, a chamber or moon pool 9;

and a downwardly projecting lower end portion 11 of tube 3 extends a substantial distance from the lowermost point of securement of tube 3 to the hull, down into chamber 9. Downwardly projecting portion 11 is spaced from the side walls of chamber 9, that is, is spaced from the hull of the ship.

A rigid ring 13 is secured to the inside of the lower end of downwardly projecting portion of tube 3. Alternatively, of course, ring 13 could surround the lower end of portion 11.

For clarity of illustration, rigid ring 13 is shown as a solid member. Its size is such, however, that as a practical matter it will ordinarily be of hollow or ribbed construction, for example in the form of a box section.

A vertical rotary tube or turret having a lower portion 15 and an upper portion 16 is supported on rigid ring 13 by an axial/radial bearing 17, which is in the illustrated embodiment a roller bearing having an outer race secured to ring 13 and an inner race secured to lower portion 15. At its lower end, lower portion 15 carries a chaintable 19 to which are secured anchor chains shown diagrammatically at 21, by which the ship is moored to the sea floor.

Tube 15, 16 is hollow from top to bottom, and conduits 23 and 25 extend vertically therethrough to serve, e.g., as gas and hydrocarbon product risers.

In operation, the ship is moored to a relatively fixed position by anchor chains 21 so that gaseous and/or liquid products ca rise through conduits 23 and 25 for storage onboard or transportation to shore. Thanks to the position of the rotary tube 15, 16 amidships or in any event between stern and bow, this connection is subjected to minimum influence from pitching and yawing of the vessel.

Moreover, during such pitching, yawing and rolling of the vessel under the influence of the waves, the hull of the ship will rack: such a large-size vessel is in effect not a static structure but rather a dynamic structure; and anything rigidly connected to spaced portions of the hull will be subjected to great strain.

And so the fixed tube 3 where it is connected to the hull will be deformed. But this deformation will not be passed on to rigid ring 13, because the downwardly projecting portion 11 of fixed tube 3, between the hull and ring 13, is not secured to the hull and is therefore free to deform at its upper end but not at its lower end because the rigid ring 13 holds it against deformation at its lower end and, more importantly, holds the outer bearing race of bearing 17 against deformation. The inner race of bearing 17 is not subjected to deformation by racking of the hull in any event, because it is not connected to the hull other than by the outer ring of bearing 17.

In view of the foregoing disclosure, therefore, it will be seen that the initially recited object of the present invention has been achieved.

Although the present invention has been described and illustrated in connection with a preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. Ship with mooring means, comprising a rotatable tube (15) which is connected to the ship (1) for rotation about a vertical axis which is concentric to the rotatable tube, by means of an axial/radial bearing structure (17) which can absorb axial and radial forces, and said rotatable tube (15) having at its lower end means (19) for fastening anchor chains or cables (21), the rotatable tube (15) being disposed inside the hull of the ship (1) within a fixed tube (3) through the lower end of which said rotatable tube (15) protrudes downwardly, a bearing ring of said axial/radial bearing (17) being in integral assembly with a rigid ring (13) which is in turn fastened only to the lower end of said fixed tube (3), said fixed tube (3) enclosing the rotatable tube (15) with clearance, said fixed tube (3) being fastened to the hull of the ship only some distance away from and above the rigid ring (13) and being free from fixed securement to the ship below said rigid ring (13), and wherein said axial/radial bearing (17) providing the sole axial bearing of said rotatable tube (15)

2. Ship according to claim 1, wherein the rotatable tube (15) has an upwardly extending portion (16) above the said axial/radial bearing (17).

3. Ship according to claim 1, wherein said rigid ring (13) is disposed within a downwardly projecting portion (11) of said fixed tube (3), said outer ring of said axial/radial bearing (17) being fixed to said rigid ring (13).

4. Ship according to claim 2, wherein an inner ring of said axial/radial bearing (17) is fixed to said rotatable tube (15).

5. Ship according to claim 1, said fixed tube (3) being disposed between the bow and the stern of the ship.

* * * * *